United States Patent [19]

Cai

[11] Patent Number: 5,055,117

[45] Date of Patent: Oct. 8, 1991

[54] AIR FILTERING APPARATUS

[75] Inventor: Zhixia Cai, Beijing, China

[73] Assignee: Tsinghua University, Beijing, China

[21] Appl. No.: 524,292

[22] Filed: May 15, 1990

[30] Foreign Application Priority Data

May 23, 1989 [CN] China ..... 89208018.3

[51] Int. Cl.[5] ..... B03C 3/14

[52] U.S. Cl. ..... 55/126; 55/146

[58] Field of Search ..... 55/101, 124, 126, 146, 55/140

[56] References Cited

U.S. PATENT DOCUMENTS

| | | | |
|---|---|---|---|
| 3,027,970 | 4/1962 | Mueller | 55/146 X |
| 3,181,285 | 5/1965 | Tepolt et al. | 55/146 X |
| 3,438,180 | 4/1969 | Klouda | 55/126 |
| 3,705,478 | 12/1972 | Vaneldik et al. | 55/146 X |
| 3,765,154 | 10/1973 | Hardt et al. | 55/146 |
| 4,597,781 | 7/1986 | Spector | 55/126 |

*Primary Examiner*—Richard L. Chiesa
*Attorney, Agent, or Firm*—Rines & Rines

[57] ABSTRACT

An air filtering apparatus for obtaining high purity purified air by separating diffused particles from air, including a fibre filter, an upper porous plate, a lower porous plate, and a purification means fixed between the upper porous plate and the lower porous plate. The air carrying bacteria and dust particles is purified by the pre-filtration of the fibre filter and the re-filtration inside the electric field of the purification means. The apparatus is particularly useful in the production of monosodium glutamate, citric acid, enzymic preparations of the foodstuff industry and other industries and obviates filter orifice blocking, permitting longer operating life.

11 Claims, 3 Drawing Sheets

AIR FILTERING APPARATUS

FIELD OF THE INVENTION

The present invention relates to the separation of diffused particles from air to obtain purified air, particularly relating to air filtering apparatus for the acquisition of high purity purified air.

BACKGROUND OF THE INVENTION

Recently, in the production of monosodium glutamate, citric acid, and the enzymic preparation of the foodstuff industry, as well as in medical application, both filtrators of relatively large size with filters constituted of active carbon, wood flour, cotton, etc. and filtrators of relatively small size with high efficiency μm level have been used. The latter has the problem of the filtering orifices becoming blocked and thus being blocked and subject to a shorter operative life. The small diameter of the membrane orifices, moreover, is manufactured as small as 0.1 μm, and the degree of the purity of the filtered air has been unsatisfactory.

OBJECTIVE OF THE INVENTION

The object of the present, therefore, is to provide an air filtering apparatus for efficiently capturing bacteria and dust particles to obtain high purity purified air.

Other and further objects will be explained hereinafter and are more particularly delineated in the appended claims.

SUMMARY OF THE INVENTION

The air filtering apparatus of the present invention comprises, in summary, a fibre filter, an upper porous plate, purification means, and a lower porous plate, wherein said upper porous plate adjoins to said fibre filter, said purification means is disposed between said upper porous plate and lower porous plate, and said purification means includes an electric field for capturing charged particles.

The operation of the air filtering apparatus of the present invention is as follows: Warm and wet compressed air carried bacteria and dust particles are charged after friction and collisions in the pre-filtration of said fibre filter, and the charged particles are captured efficiently under the effect of the electric field force in the purification means created by a tubular or cylindrical electric field, thus purified the air.

The air filtering apparatus of the present invention prevents the blocking of membrane orifices and extends the operating life of the air filtering apparatus, owing to the adoption of pre-filtration by the filter and of compound filtration of said purification means the tubular or cylindrical electric field.

The detailed structure of the present invention is illustrated by the following embodiment and attached drawings.

Referring to attached drawings, the following is a detailed description of the details and operations of the specific structure of preferred embodiments proposed by the present invention.

DETAILED DESCRIPTION OF A PREFERRED EMBODIMENT OF THE INVENTION

Figure 1:
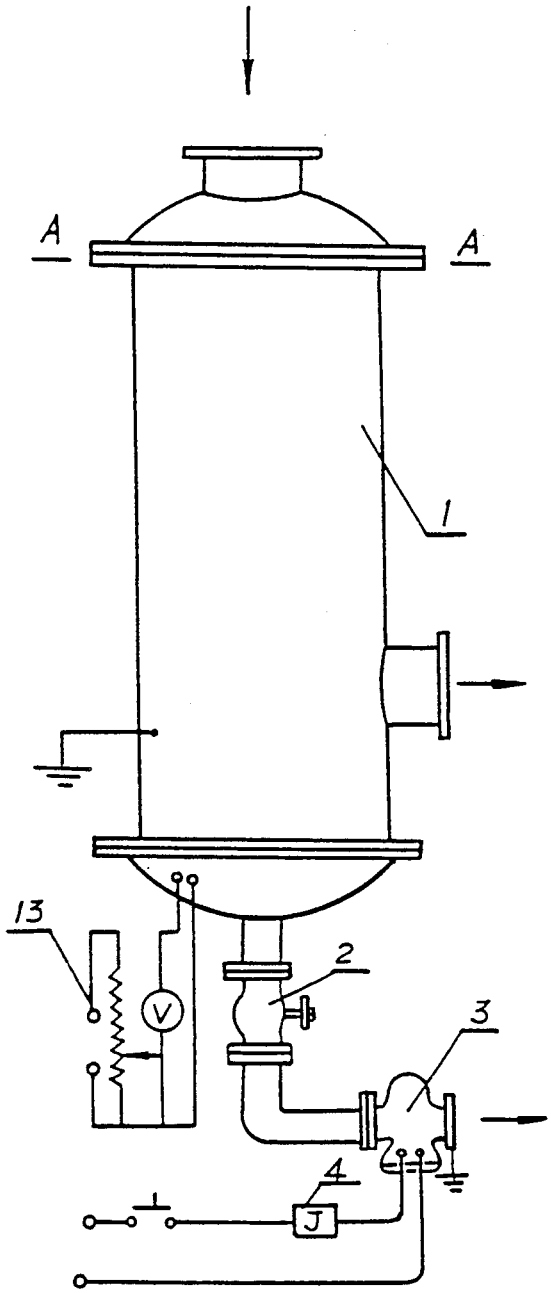
FIG. 1 is a general schematic diagram of the present invention.

FIG. 1 is a general schematic view of an air filtering apparatus proposed by the present invention, the apparatus including a housing (1) having an inlet (top vertical arrow), an outlet for purified air, (center horizontal arrow), and a bottom outlet (bottom horizontal arrow) for captured particles. The housing (1) can be made of non-metallic materials with its bottom outlet connected to a manual adjusting valve (2). The housing (1) is connected to an electromagnetic gas valve (3) and a normally closed contact time relay (4) via the manual adjusting valve (2). There are terminals on the cover plate of with housing (1) coupled with power supply 13.

Figure 2:
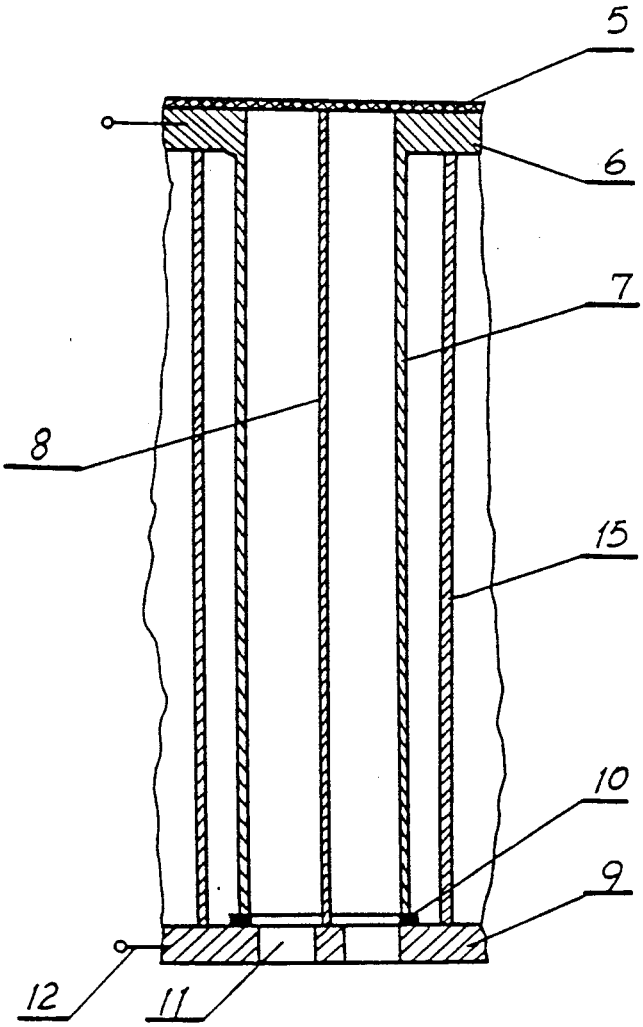
FIG. 2 is a partial sectional view of the air filtering apparatus a tubular electric field, as a preferred and best mode embodiment of the present invention.

FIG. 2 illustrates a partial sectional view of such an air filtering apparatus provided with a tubular electric field, wherein a metallic upper porous plate (6) adjoins fibre filter (5). The top end of a vertical metallic tube (7) having orifices is fixed to the metallic upper porous plate (6), and its bottom end is sealed at being insulated from the metallic lower porous plate (9) by an insulation washer (10). A metallic tubular core (8) is also fixed on the metallic lower porous plate (9) and is positioned to extend coaxially inside the metallic tube (7), the length of the metallic tube core (8) being a little shorter than that of the metallic tube (7), and with a membrane tube (15) disposed between the metallic upper porous plate (6) and the metallic lower porous plate (9). In the present embodiment, the metallic upper porous plate (6) and the metallic tube (7) are an integrated entity with the metallic tube core (8) and the metallic lower porous plate (9) being also integral. Thus, a tubular electric field is generated between the metallic tube core (8) and the metallic tube (7), when terminals (12) on the metallic upper porous plate (6) and metallic lower porous plate (9) are coupled with the power supply (13). When the warm and wet compressed air from the top carrying bacteria and dust particles into the inlet of the housing (1) of the air filtering apparatus passes through the fibre filter (5), the bacteria and dust particles are charged with static electricity due to collisions and friction, under the effect of the electric field force. These charged particles are detained in the space enclosed by the metallic tube core (8) and the metallic tube (7). The purified air passing through the orifices of the metallic tube (7) further experiences inertial collisions on the inner wall of the membrane tube (15), with interception near the membrane orifices and diffusion therein thus, purified air with high purity can be obtained, and the purified air is outputted from the outlet of the housing (1) for use as in manufacturing.

A smooth metallic tube (7) may also be used instead of the membrane tube (15), with the tubular electric field being formed between the metallic tube (7) and the metallic tube core (8) when terminals (12) are coupled with power supply (13). The the charged particles are efficiently captured in the tubular electric field, with the purified air free of charged bacteria and dust particles at the outlet (11) of an air purification system so used in manufacturing.

Figure 3:
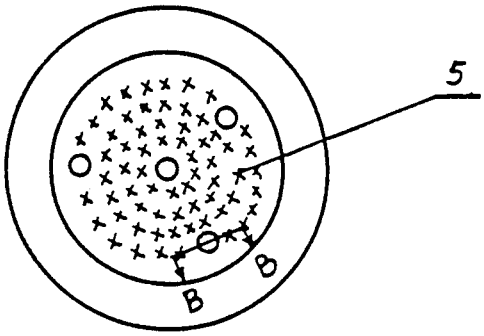
FIG. 3 is a sectional view, taken along the line A—A in FIG. 1, of the air filtering apparatus with a cylindrical electric field, as a modification of the present invention.

FIG. 3 illustrates sectional view of along the line A—A of FIG. 1 of a modification of the present invention, in which the air filtering apparatus employs a cylindrical electric field, i.e. a sectional view taken from the upper porous plate (6) made of insulation material.

Figure 4:
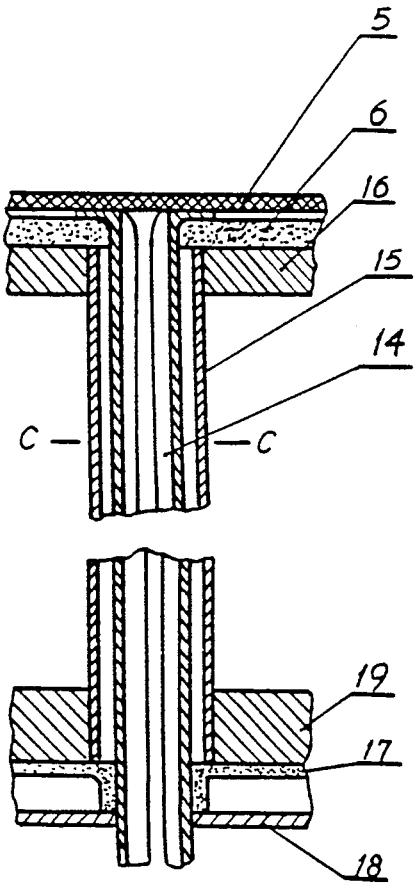
FIG. 4 is an enlargement of the sectional view, taken along the line B—B of FIG. 3, of the air filtering apparatus with the cylindrical electric field.

FIG. 4 is an enlargement taken along the line B—B of FIG. 1, illustrating such an air filtering apparatus with a cylindrical electric field, as a further embodiment of the present invention, wherein the upper porous plate (6), also made of insulating material, adjoins the fibre filter (5), and a membrane tube upper porous plate (16) also adjoins the upper porous plate (6). The top end of the membrane tube (15) is fixed in a hole of the membrane tube upper porous plate (16), with both the membrane tube (15) and the membrane tube upper porous plate (16) being made of non-metallic material. An apertured or slitted tube cylindrical electrode (14) with orifices is disposed within the membrane tube (15), with its top end fixed between the fibre filter 5 and the upper porous insulating plate (6). The lower porous insulating plate (17) is fixed beneath the membrane tube lower porous plate (19), with the bottom end of the membrane tube (15) being fixed in the hole of the membrane tube lower porous non-metallic plate (19). A cover plate (18) with circuits for each electrode section is fixed beneath the lower porous insulating plate (19), and terminals coupled with the apertured or slitted electrode sections are arranged on the circumferences of each hole of the cover plate (18). A cylindrical electric field is thereby formed between the apertured or slitted electrode sections or pairs when the terminals are coupled with the power supply (13).

Figure 5:
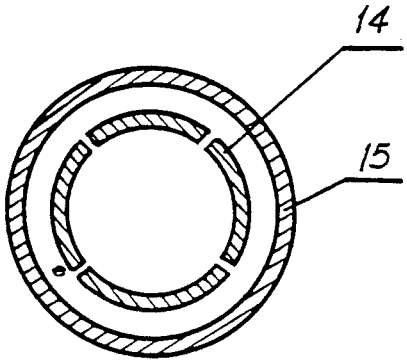
FIG. 5 is an enlargement of the sectional view, taken along the line C—C in FIG. 4, of the air filtering apparatus with the cylindrical electric field, embodiment.

FIG. 5 is an enlarged sectional view, taken along the line C—C of FIG. 4, of the air filtering apparatus with its cylindrical electric field, of FIG. 4 and in which the slitted electrode. A screen-grid pair (14) is encased in the membrane tube (15).

The operational conditions of the air filtering apparatus of FIGS. 3-5 using the cylindrical electric field is as follows. The warm and wet compressed air carrying bacteria and dust particles enters along the direction shown by the arrow on the top of housing (1) of the air filtering apparatus, and passes through the fibre filter (5) to be pre-filtered, though in some plants and environments, the pre-filtering may not be required. At this time, the bacteria and dust particles become charged with static electricity due to collisions and friction entering the cylindrical electric field of the pair or plurality of pairs of slitted electrodes (14) energized from the power supply (13), such are intercepted and detained in the space surrounded by the cylindrical electric field of the slitted electrodes (14), while the purified air experiences inertial collisions on the inner wall of the membrane tube, and with interception near, and diffusion in the membrane orifices, thus purified air with high degree of purity is obtained, which is outputted along the direction shown by the lowermost arrow on the outlet of housing (1) of the air filtering apparatus, FIG. 1.

The warm and wet compressed air carrying bacteria and dust particles is thus purified in the air purification means with the aid of the electric field, while the bacteria and dust particles detained in the air purification means are removed in the following manner. The before-mentioned electromagnetic gas valve (3) controlled by the normal closed contact time relay (4), FIG. 1, is opened after a predetermined time interval to allow the warm and wet compressed air inside the membrane tube (15) to expand due to a rapid drop of pressure. Dew Drops are condensed on nuclei of detained bacteria and dust particles, and these are removed in the direction indicated by the lowermost horizontal arrow on the side of the electromagnetic gas valve (3) linked to the bottom outlet of the housing (1) of the air filtering apparatus. The bacteria dust particles detained on the surface of the slitted electrodes, and the dewdrops are also removed in the same direction. While the normally closed contacts of the time relay (4) are opening moreover, the electromagnetic gas valve (3) is closing as, thus providing air filtering circulation.

What is claimed is:

1. An air filtering apparatus comprising a housing having an air inlet, an outlet for purified air, and a bottom outlet for captured particles, a fibre filter, an upper porous plate, a lower porous plate, and a purification means, wherein said upper porous plate is adjoined to said fibre filter, said purification means is fixed between said upper porous plate and said lower porous plate, and said purification means comprises electrodes producing an electric field for capturing charged particles, and wherein said purification means further comprises a metallic tube having orifices therein; a metallic tube core, and a membrane tube, a top end of said metallic tube being fixed beneath said upper porous plate, and a bottom end thereof being sealed with said lower porous plate, said metallic tube core extending vertically upward and being fixed on said lower porous plate and positioned inside said metallic tube and said membrane tube being disposed between said upper porous plate and said lower porous plate.

2. An air filtering apparatus according to claim 1, wherein, both said upper porous plate and said lower porous plate are metallic porous plates.

3. An air filtering apparatus comprising a housing having an air inlet, an outlet for purified air, and a bottom outlet for captured particles, a fibre filter, an upper porous plate, a lower porous plate, and a purification means, wherein said upper porous plate is adjoined to said fibre filter, said purification means is fixed between said upper porous plate and said lower porous plate, and said purification means comprises electrodes producing an electric field for capturing charged particles, and wherein, said purification means further comprises at least a pair of slitted electrodes having orifices therein and a membrane tube, a top end of said electrodes being fixed between said fibre filter and said upper porous plate, said electrodes being cased inside said membrane tube, the top and bottom ends of said membrane tube being fixed on said upper porous plate and said lower porous plate respectively.

4. An air filtering apparatus according to claim 3, wherein, said upper porous plate and said lower porous plate are porous plates made of insulation material.

5. An air purification means with a tubular electric field, comprising a fibre filter, a metallic tube having orifices, a metallic tube core, an upper porous plate, a lower porous plate, and a membrane tube, said upper porous plate being adjoined with said fibre filter, a top end of said metallic tube being fixed beneath said upper porous plate, a bottom end thereof being sealed with said lower porous plate, said metallic tube core extending vertically upward being fixed on said lower porous plate and positioned inside said metallic tube and said membrane tube being disposed between said upper porous plate and said lower porous plate, said air purification means having electrodes for producing said electric field.

6. An air purification means according to claim 5, wherein, said upper porous plate and said lower porous plate are metallic plates including terminals for coupling said metallic tube and said tube core with a power supply.

7. An air purification means according to claim 5, wherein, said metallic tube core is coaxially disposed with said metallic tube.

8. An air purification means according to claim 7, wherein, the length of said metallic tube core is less than that of said metallic tube.

9. An air purification means with a cylindrical electric field, comprising a fibre filter, at least a pair of apertured electrodes, and upper porous plate, a lower porous plate, and a membrane tube, said upper porous plate being adjoined to said fibre filter, a top end of said electrode being fixed between said fibre filter and said upper porous plate, said electrodes being cased inside said membrane tube, and the top end and bottom end of said membrane tube being fixed on said upper porous plate and said lower porous plate respectively.

10. An air purification means according to claim 9, wherein, said upper porous plate and said lower porous plate are porous plates made of insulation material.

11. An air purification means according to claim 9, wherein, the length of said membrane tube is less than that of said electrodes.

* * * * *